US007189932B2

(12) United States Patent
Kim

(10) Patent No.: US 7,189,932 B2
(45) Date of Patent: Mar. 13, 2007

(54) NAVIGATION KEY INTEGRALLY FORMED WITH A PANEL

(75) Inventor: Il-kwun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/038,266

(22) Filed: Jan. 21, 2005

(65) Prior Publication Data

US 2005/0199476 A1 Sep. 15, 2005

(30) Foreign Application Priority Data

Mar. 9, 2004 (KR) ..... 10-2004-0015741

(51) Int. Cl.
*H01H 13/70* (2006.01)
*H01H 25/00* (2006.01)
*H01H 25/04* (2006.01)

(52) U.S. Cl. ..... 200/5 R; 200/5 A; 200/17 R; 200/296; 200/341; 200/345

(58) Field of Classification Search ..... 200/5 A, 200/5 R, 17 R, 520, 521, 296, 329, 341, 200/345
See application file for complete search history.

(56) References Cited

U.S. PATENT DOCUMENTS 5,193,667 A * 3/1993 Choi ..... 200/331
5,862,071 A * 1/1999 Scholder ..... 365/52
6,667,447 B2 * 12/2003 Liu et al. ..... 200/5 R
6,914,203 B2 * 7/2005 Suzuki ..... 200/6 A
6,960,732 B1 * 11/2005 Spiegel et al. ..... 200/296
2003/0127307 A1 7/2003 Liu et al.

FOREIGN PATENT DOCUMENTS

| | | |
|---|---|---|
| JP | 03-263640 | 11/1991 |
| JP | 08222086 | 8/1996 |
| JP | 10-334537 | 12/1998 |
| JP | 2002215290 | 7/2002 |
| KR | 1997-71612 | 7/1997 |

* cited by examiner

*Primary Examiner*—Elvin Enad
*Assistant Examiner*—Lheiren Mae A. Anglo
(74) *Attorney, Agent, or Firm*—Roylance, Abrams, Berdo & Goodman LLP

(57) ABSTRACT

A navigation key integrally formed with a panel in an electronic device comprises an outer key formed to have a resilient restoring force, and a holder for receiving the outer key, the holder integrally mounted on the panel. The holder comprises a tact pressing member for directly pressing a tact switch disposed thereunder when the outer key is pressed down.

10 Claims, 5 Drawing Sheets

NAVIGATION KEY INTEGRALLY FORMED WITH A PANEL

CROSS-REFERENCE TO RELATED APPLICATIONS

This application claims the benefit under 35 U.S.C. §119 (a) of Korean Patent Application No. 2004-15741, filed Mar. 9, 2004, in the Korean Intellectual Property Office, the entire disclosure of which is incorporated herein by reference.

BACKGROUND OF THE INVENTION

1. Field of the Invention

The present invention relates to a navigation key. More particularly, the present invention relates to a navigation key which is integrally formed on a panel.

2. Description of the Related Art

General panels, especially front panels, of televisions, videos, audios and digital versatile disc (DVD) players have a plurality of keys for operating the appliance. These keys are usually formed as single keys linearly arranged to operate a tact switch disposed underneath the key. However, since the linear single keys take up a large amount of space on the front panel, a navigation key having a substantial circular shape has been recently applied to the front panel.

FIGS. 1 and 2 illustrate a conventional circular navigation key. FIG. 1 is a perspective view showing an operation key 10 and a holder 20 connected to each other, and FIG. 2 is a front view of the operation key 10. The circular navigation key comprises a center key 12 of a substantially cylindrical form disposed in the center, four separate keys 14 formed around an outer peripheral of the center key 12, and the holder 20 receiving the above keys. The center key 12 and the separate keys 14 respectively comprise a center-key tact projection 13 and separate-key tact projections (not shown) penetrating the holder 20 to press tact switches (not shown) disposed thereunder. Therefore, if the center key 12 and the plurality of separate keys 14 are pressed, the center-key tact projection 13 and the separate-key tact projections (not shown) press the tact switches, thereby operating the electronic device.

To lower manufacturing cost and simplify the manufacturing process, the center key 12 and the plurality of separate keys 14 are generally formed by injection molding plastic which allows the keys to resiliently transform. Since the keys are mounted on the front panel of the devices such as the video, the audio and the DVD player, the plastic keys are plated to have a smooth exterior. However, when the tact projections of the plated center key 12 and the separate keys 14 directly touch the tact switch, static electricity may be generated on the circuit board connected to the tact switch, thereby causing damage to the devices. To prevent this, a nonconductive liquid insulator needs to be applied to every end of the tact projections with a brush. Since the conventional navigation key comprises one center key 12 and four separate keys 14, a total of five ends of the tact projections should have the nonconductive liquid insulator applied. This step in the manufacturing process is time consuming and results in higher costs. Further, the conventional navigation key needs a plurality of keys, a holder for supporting the keys and a dedicated fixing member for fixing the holder to the front panel. Therefore, the structure has become very complex, and requires a great deal of time to assemble Accordingly, a need exists for a navigation key that is easy to assemble and reduces the amount of static electricity that may be generated when the navigation key is used.

SUMMARY OF THE INVENTION

An aspect of the present invention is to solve at least the above problems and/or disadvantages and to provide at least the advantages described below. Accordingly, an aspect of the present invention is to provide a navigation key integrally formed with a front panel of electronic devices, such as a television, an audio, a video and a DVD player.

In order to achieve the above-described aspects of the present invention, there is provided a navigation key mounted on a panel of electronic devices, comprising an outer key formed to have a resilient restoring force, and a holder for receiving the outer key, the holder integrally mounted on the panel. The holder comprises a tact pressing member for directly pressing a tact switch disposed thereunder when the outer key is pressed down. Accordingly, since the holder directly presses the tact switch instead of the outer key which is plated, damage to the electronic device caused by static electricity can be prevented.

The outer key comprises a button part for being pressed to operate the device and a plurality of hooks for fixing the button part to the holder. The outer key further comprises a plurality of guide projections extended downward from the button part by a predetermined distance and a plurality of supporters adjoining a lower portion of the guide projections.

The holder further comprises a mounting portion for receiving the button part, a locking projection for holding the hook received, and a guide hole formed at the bottom of the mounting portion for the hook to penetrate. The tact pressing member of the holder has an upper part for supporting the supporter of the outer key, a recess of a certain depth for insertion of the guide projection therein, and a lower end for pressing the tact switch which will be disposed thereunder.

The holder further comprises a resilient member connected to the upper part of the tact pressing member for return of a position of the tact pressing member.

The outer key and the holder respectively have a substantially circular hole in the center thereof. A center key is further provided, which is fixed by a center key fixing projection formed at a rear side of the holder.

BRIEF DESCRIPTION OF THE DRAWING FIGURES

The above aspect and other features of the present invention will become more apparent by describing in detail exemplary embodiments thereof with reference to the attached drawing figures, wherein.

In the following description, the same drawing reference numerals are used for the same elements, features, and structures throughout the drawings.

DETAILED DESCRIPTION OF THE EXEMPLARY EMBODIMENTS

Hereinafter, an embodiment of the present invention will be described in detail with reference to the accompanying drawing figures.

The detailed description of the exemplary embodiments of the present invention is provided to assist in the comprehensive understanding of the present invention, while well-known features or elements have been excluded for the sake of clarity. Of course, as will be understood by one of ordinary skill in the art, the exemplary embodiments of the present invention can be implemented with various changes and modifications, without departing from the scope and spirit of the invention.

Figure 1:
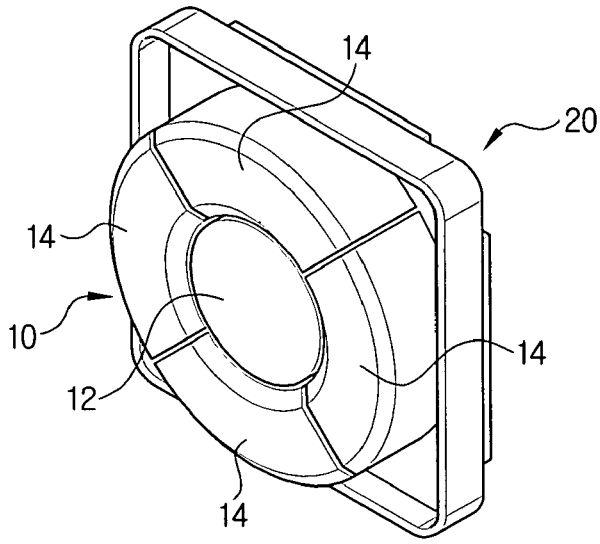
FIG. 1 (PRIOR ART)
FIG. 1 is a perspective view showing an operation key and a holder connected to each other in a conventional navigation key.
Figure 2:
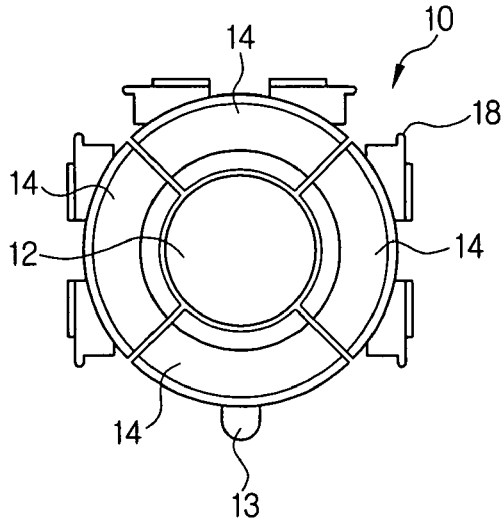
FIG. 2 (PRIOR ART)
FIG. 2 is a front view of the operation key of FIG. 1.
Figure 3:
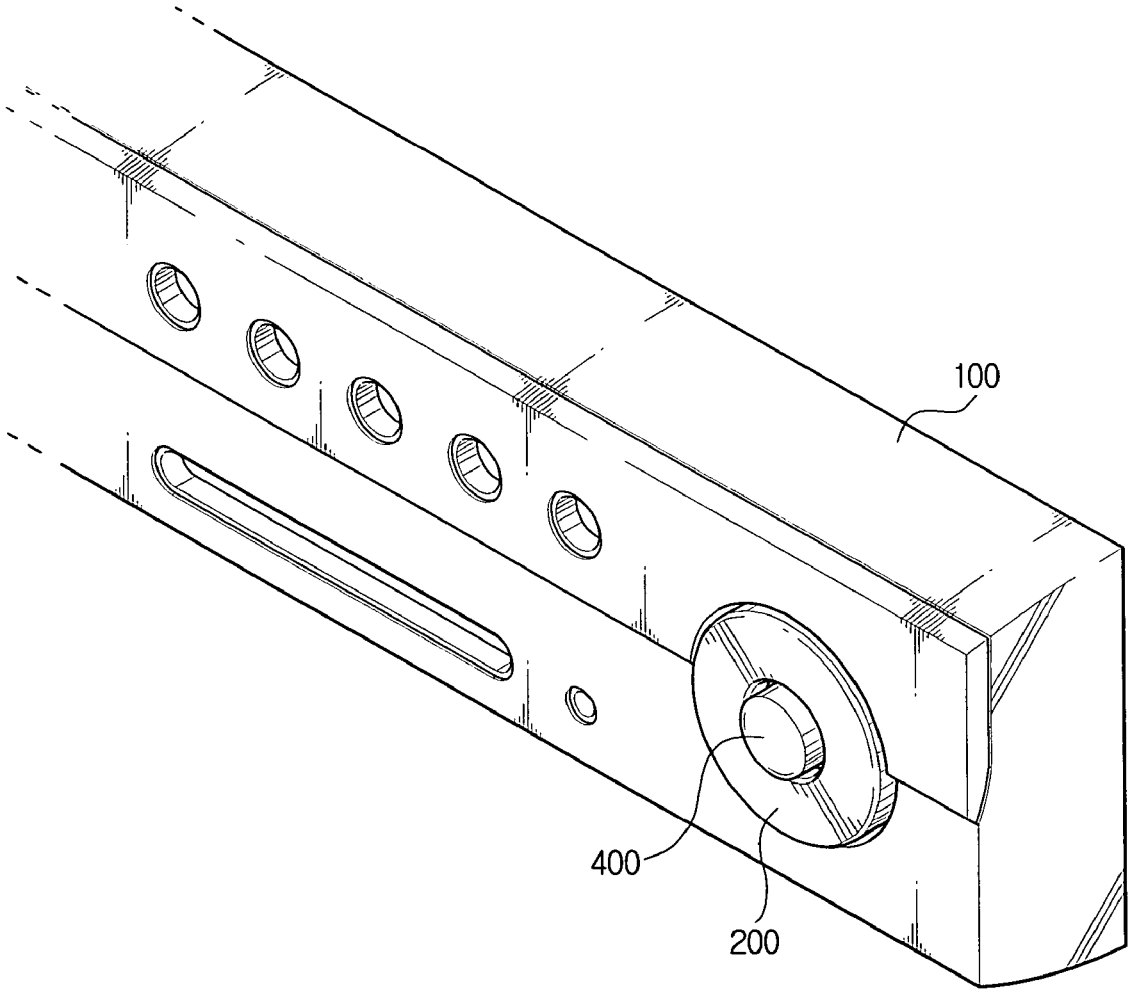
FIG. 3 is a perspective view showing a front side of a panel in which an outer key is connected to a holder, according to an embodiment of the present invention.
Figure 4:
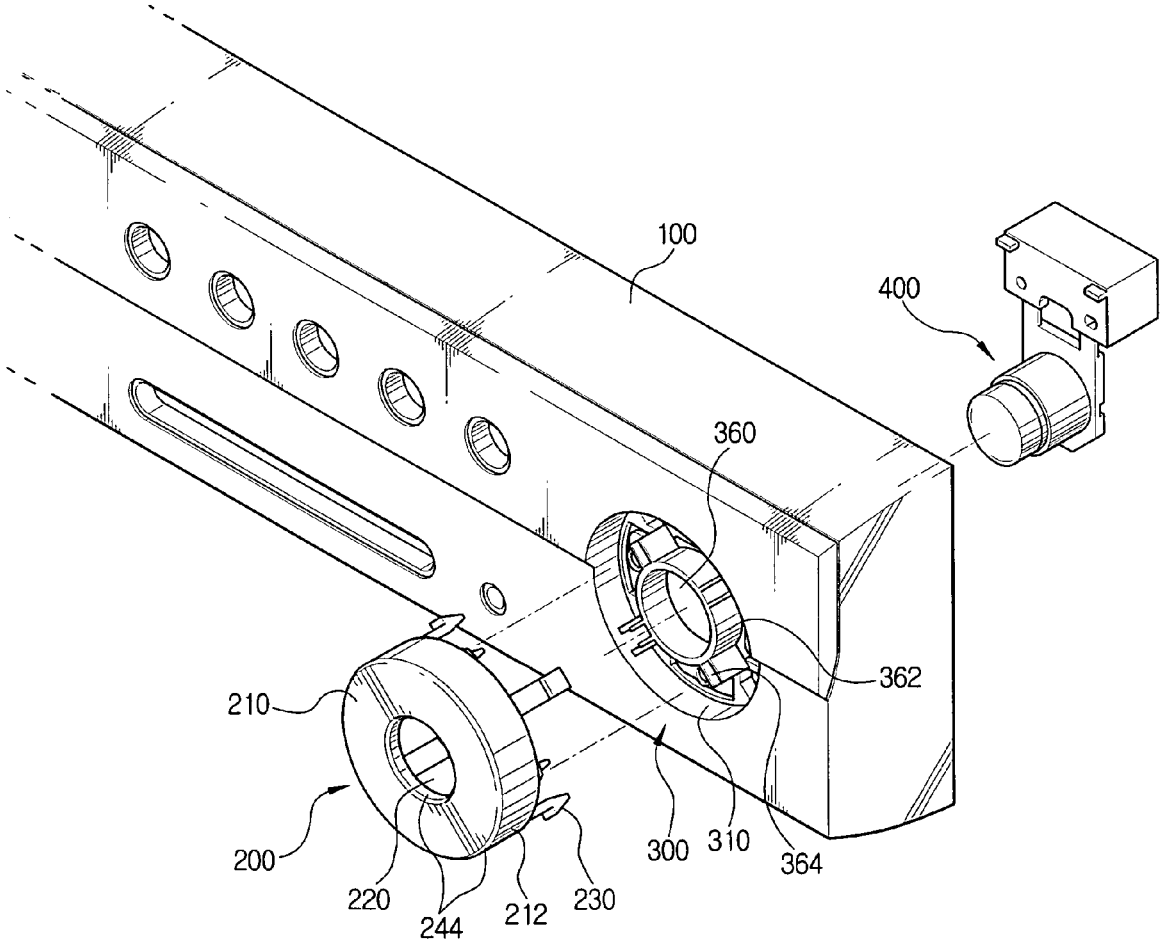
FIG. 4 is an exploded and perspective view showing the connection state of FIG. 3.

FIG. 3 is a perspective view showing a front side of a panel in which an outer key is connected to a holder, according to an embodiment of the present invention. A navigation key integrally formed with the panel, according to an embodiment of the present invention, comprises an outer key 200 having a substantially cylindrical form, a holder 300 (shown in FIG. 4) is formed in a panel 100 to receive and support the outer key 200, and a center key 400. The panel 100 is a general front panel of an electronic device, such as a television, a video device, an audio device, a DVD player or the like, on which a plurality of operation keys are linearly mounted. The outer key 200 is an operation key for performing the main functions of the electronic device, such as playing, rewinding, fast-rewinding, fast-forwarding, channel control, volume control, recording or the like. The outer key 200 is preferably divided into four parts along its circumference.

Referring to FIGS. 4 to 8, the outer key 200 comprises a button part 210, a plurality of hooks 230, a plurality of guide projections 240, and a plurality of supporters 242. The outer key 200 has in the center thereof a substantially circular button hole 220 for receiving the center key 400 which will be described in more detail.

The button part 210 comprises the button hole 220 in the center, a flank surface 212 having a predetermined depth to surround an outer circumference thereof. The button part 210 is received in the holder 300. A smooth part 244 is formed at top edges along outer and inner circumferences of the button part 210 for smooth operation of the button part 210.

The plurality of hooks 230 are extended downward from the flank surface 212 of the button part 210 and preferably disposed to divide the outer circumference of the button part 210 into four even parts. The hook 230 is received in engagement with a locking projection 322, thereby forming tension to prevent the button part 210 from being inserted into the holder 300 by more than a certain depth, and fixing the button part 210 to the holder 300.

The plurality of guide projections 240 are extended downward from an inner side of the flank surface 212 by a predetermined distance. The guide projections 240 are also spaced at four even intervals on the outer circumference of the button part 210, however, each guide projection 240 is disposed approximately in the middle of every two hooks 230.

The plurality of supporters 242 protrude downward from the flank surface 212 of the button part 210 to respectively adjoin the lower part of the guide projections 240. The supporter 242 is supported by an upper part 342 of the tact pressing member 340 of the holder 300, and in this state, when the button part 210 is pressed, the tact pressing member 322 is also depressed, thereby pressing the tact switch, which will be described in more detail below.

Figure 7:
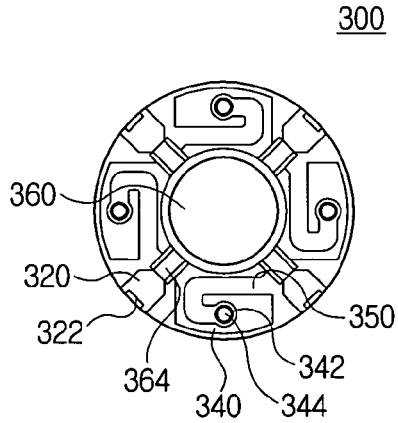
FIG. 7 is a front view of the holder of FIG. 4.
Figure 8:
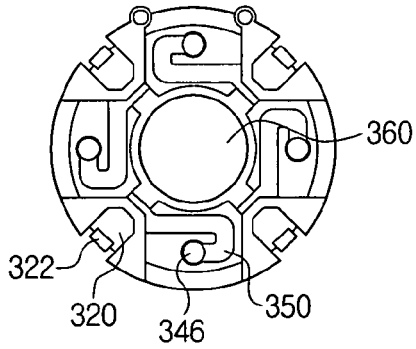
FIG. 8 is a rear view of the holder of FIG. 4.

Referring to FIG. 7, the holder 300 comprises a mounting portion 310, a plurality of guide holes 320 and locking projections 322 formed at a lower part thereof, the tact pressing member 340, an resilient member 350, and a substantially circular holder hole 360 for receiving the center key 400 which will be described in more detail below.

The mounting portion 310 (shown in FIG. 4) has a depth corresponding to the depth of the flank surface 212 of the button part 210 to receive the button part 210.

A plurality of guide holes 320 are provided in several locations at the bottom of the mounting portion 310 for the hooks 230 of the button part 210 to enter. The locking projection 322 is extended by a predetermined distance from a lower part of the guide hole 320 and adjoining the guide hole 320. The hook 230 resiliently transforms as it passes through the guide hole 320 while sliding down and engaging the locking projection 322. As described above, since the hook 230 is fixed by the locking projection 322, the button part 210 is not inserted by more than a predetermined depth into the holder 300.

The tact pressing member 340 is disposed substantially in the middle of two adjacent guide holes 320. The supporter 242 of the outer key 200 is supported by the upper part 342 of the tact pressing member 340. A recess 344 of a certain depth is formed for insertion of the guide projection 242 within the tact pressing member 340. A lower end 346 of the tact pressing member 340 presses the tact switch (not shown) which will be disposed thereunder.

The resilient member 350 is connected to the upper part 342 of the tact pressing member 340 so that the tact pressing member 340 has a resilient restoring force. More specifically, if the button part 210 is pressed, the tact pressing member 340 is moved down, and if the button part 210 is released from the force of being pressed, the tact pressing member 340 returns to its initial position by the resilient member 350. As shown in FIG. 7, the resilient member 350 is connected to the upper part 342 of the tact pressing member 340 by one end and to an outer surface of the guide hole 320 by the other end. Here, the resilient member 350 does not have a straight form to link the upper part 342 of the tact pressing member 340 and the outer surface of the guide hole 320 in the shortest way, but is angled several times to have a certain length. This is for enhancing and prolonging the resilient restoring force of the resilient member 350. If the resilient member 350 were short, a higher force for pressing the tact pressing member 340 would need to be applied, and the force would be focused on a certain area. Therefore, the resilient member 350 would be more likely to break. Since the outer key 200 is generally used as an operation key which is used most frequently from among all the operation keys of the electronic device, the resilient member 350 is preferably formed as a crooked or angled part having a predetermined length.

The outer key 200 and the holder 300 are made by injection molding plastic, which creates resilient parts. In particular, the outer key 200 is usually plated to have a smooth exterior since it is mounted on the front panel formed on a front side of the electronic device. According to an embodiment of the present invention, the tact switch is not pressed by the plated outer key 200 directly, but by the tact pressing member 340 of the holder 300, which is also formed of plastic. Therefore, generation of static electricity is prevented, and the electronic device can be stably operated without being damaged by the static electricity.

Referring back to FIG. 4, the holder hole 360 is protruded upward from a bottom of the holder 300 to have an outer surface 362, which is substantially equal to the depth of the mounting portion 310. A hook guiding recess 364 is formed on the outer surface 362 to guide the hook 230 of the outer key 200 to the guide hole 320.

Figure 5:
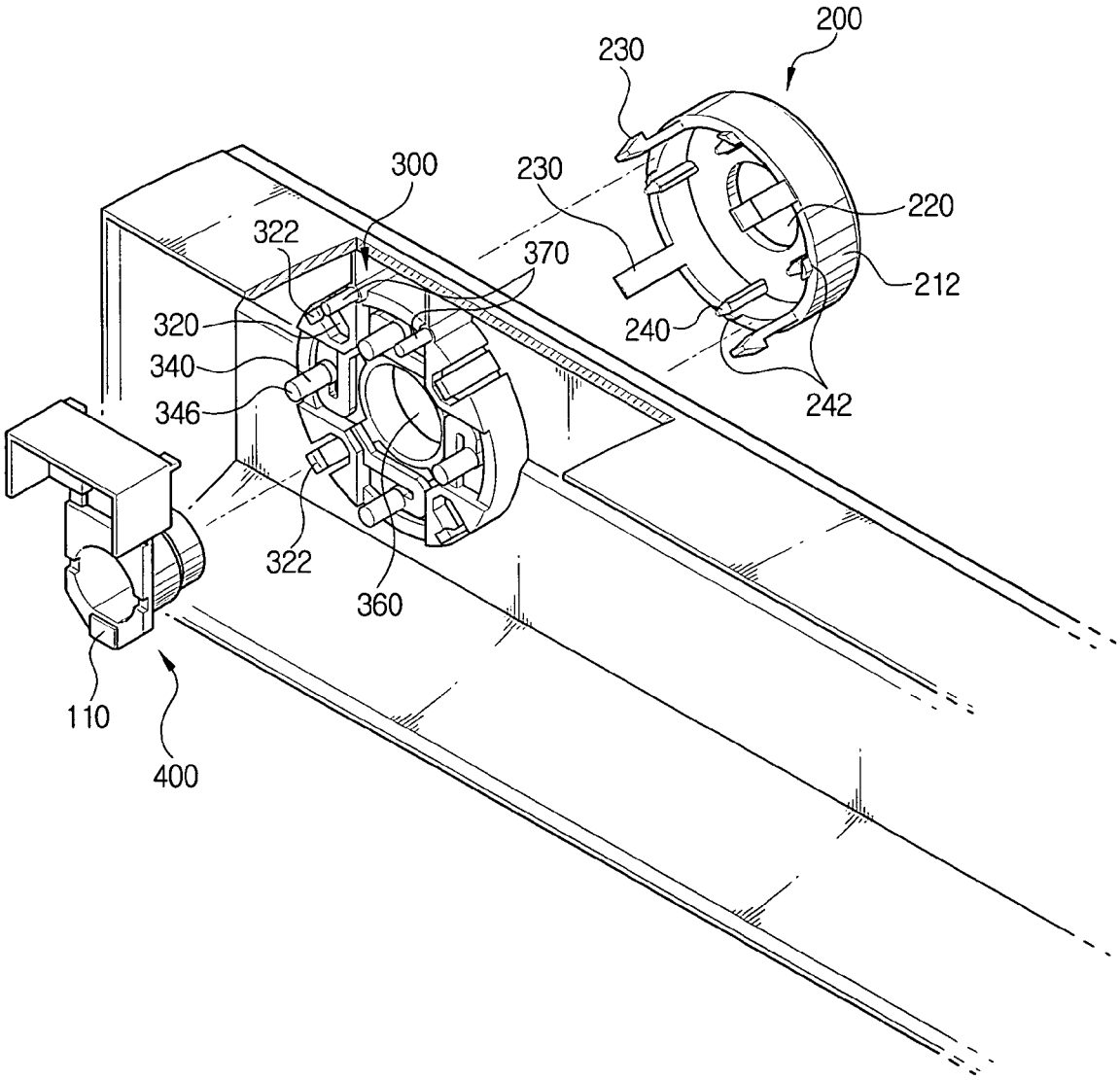
FIG. 5 is an exploded and perspective view showing a rear side of FIG. 4.
Figure 6:
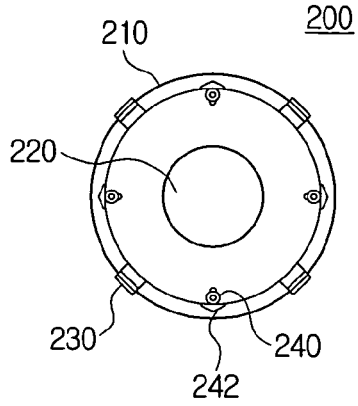
FIG. 6 is a rear view of the outer key of FIG. 4.

Referring to FIG. 5, the center key 400 is fixed by a center key fixing projection 370 formed on a rear side of the holder 300 and inserted in the holder hole 360 and the button hole 220 from a rear side of the holder 300. The center key 400 has a dedicated tact contacting surface 110 for directly pressing the tact switch.

The process for inserting the outer key 200 and the center key 400 into the holder 300 and the operation of the keys will now be described with reference to the accompanying drawings.

When the hook 230 of the outer key 200 is inserted in the guide hole 320 of the holder 300 and pressed down, the hook 230 resiliently transforms and engages the locking projection 322 of the holder 300. Connection of the outer key 200 is easy since by inserting any one hook 230 in one guide hole 320, the other hooks 230 are accordingly inserted in the rest guide holes 320. In addition, by engaging the center key 400 with the center key fixing projection 370 of the holder 300, the assembly process is completed. As described above, the assembling process is very simple, and therefore, productivity is increased. If necessary, separation of the outer key 200 and the center key 400 is performed in the reverse order.

As can be appreciated from the above description, the holder 300, instead of the outer key 200, directly touches the tact switch to prevent damage on the electronic device caused by static electricity. Also, due to the simple structure, assembly time of the device is reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A navigation key which is integrally formed with a panel in an electronic device, comprising:

an outer key formed to have a resilient restoring force; and a holder for receiving the outer key, the holder integrally formed in the panel, wherein the holder comprises a tact pressing member for directly pressing a tact switch disposed thereunder when the outer key is pressed down.

2. The navigation key of claim 1, wherein the outer key comprises a button part for being pressed to operate the device and a plurality of hooks for fixing the button part to the holder, and the holder further comprises a mounting portion for receiving the button part, and a locking projection for holding at least one of the plurality of hooks received.

3. The navigation key of claim 2, wherein the holder further comprises a guide hole formed at a bottom of the mounting portion for the at least one of the plurality of hooks to enter.

4. A navigation key which is integrally formed with a panel in an electronic device, comprising:

an outer key formed to have a resilient restoring force; and a holder for receiving the outer key, the holder integrally mounted on the panel;

wherein the holder comprises a tact pressing member for directly pressing a tact switch disposed thereunder when the outer key is pressed down;

wherein the outer key comprises a button part for being pressed to operate the device and a plurality of hooks for fixing the button part to the holder, and the holder further comprises a mounting portion for receiving the button part, and a locking projection for holding at least one of the plurality of hooks received;

wherein the holder further comprises a guide hole formed at a bottom of the mounting portion for the at least one of the plurality of hooks to enter;

wherein the outer key further comprises a plurality of guide projections extended downward from the button part by a predetermined distance and a plurality of supporters adjoining a lower portion of the guide projections, and wherein a tact pressing member of the holder comprises an upper part for supporting the supporter of the outer key; a recess of a certain depth for insertion of at least one of the plurality of guide projections within an upper part thereof, and a lower end for pressing the tact switch which will be disposed thereunder.

5. The navigation key of claim 4, wherein the holder further comprises a resilient member connected to the tact pressing member for return to a position of the tact pressing member.

6. The navigation key of claim 5, wherein the resilient member is angled rather than straight.

7. The navigation key of claim 6, wherein the outer key and the holder respectively have a substantially circular hole in the center thereof, and a center key is further comprised, which is fixed by a center key fixing projection formed at a rear side of the holder.

8. The navigation key of claim 7, wherein the panel may be a front panel mounted on a front of an electronic device.

9. An operating key which is formed with a panel in an electronic device, comprising:

an operating button having a protruding part at a button body;

a holder for supporting the operating button; and a pressing member for pressing a plurality of switches in accordance with the operating button, wherein the protruding part directly pushes the pressing member, the pressing member is integrally formed with the holder, and the holder comprises a resilient member for the pressing member and the operating button to return to original positions.

10. An operating key which is formed with a panel in an electronic device, comprising:

an operating button having a protruding part at a button body;

a holder for supporting the operating button; and a pressing member for pressing a plurality of switches in accordance with the operating button, wherein the protruding part directly pushes the pressing member; and further wherein the protruding part comprises:

a pressing protrusion; and a guide protrusion for guiding the positioning of the pressing protrusion with respect to the pressing member, wherein the button body has a substantially cylindrical configuration, and the pressing member comprises a hole of a predetermined depth to receive an end of the pressing protrusion.

* * * * *